US006318749B1

(12) United States Patent
Eglitis et al.

(10) Patent No.: US 6,318,749 B1
(45) Date of Patent: Nov. 20, 2001

(54) ANGULARLY ADJUSTABLE SNOWBOARD BINDING MOUNT

(76) Inventors: Imants Eglitis, 2971 Plaza del Amo, #226, Torrance, CA (US) 90503; Christopher G. Papajohn, 409 N. Pacific Coast Hwy., Apt. #208, Redondo Beach, CA (US) 90277

( * ) Notice: Subject to any disclaimer, the term of this patent is extended or adjusted under 35 U.S.C. 154(b) by 0 days.

(21) Appl. No.: 09/567,511

(22) Filed: May 8, 2000

(51) Int. Cl.[7] ..... A63C 9/00
(52) U.S. Cl. ..... 280/607; 280/618
(58) Field of Search ..... 280/11.14, 14.2, 280/607, 613, 618, 620, 626, 633, 634

(56) References Cited

U.S. PATENT DOCUMENTS

| | | | | |
|---|---|---|---|---|
| 4,728,116 | | 3/1988 | Hill | 280/618 |
| 5,044,654 | | 9/1991 | Meyer | 280/613 |
| 5,354,088 | | 10/1994 | Vetter et al. | 280/618 |
| 5,499,837 | | 3/1996 | Hale et al. | 280/607 |
| 5,553,883 | | 9/1996 | Erb | 280/607 |
| 5,564,719 | | 10/1996 | Kisselmann | 280/14.2 |
| 5,577,755 | | 11/1996 | Metzger et al. | 280/607 |
| 5,584,492 | * | 12/1996 | Fardie | 280/618 |
| 5,586,779 | | 12/1996 | Dawes et al. | 280/14.2 |
| 5,667,237 | | 9/1997 | Laver | 280/607 |
| 5,732,959 | | 3/1998 | Soejima | 280/14.2 |
| 5,762,358 | | 6/1998 | Hale | 280/607 |
| 5,765,853 | | 6/1998 | Erb | 280/607 |
| 5,791,678 | | 8/1998 | Perlman | 280/618 |
| 5,820,139 | | 10/1998 | Grindl | 280/14.2 |
| 5,820,155 | | 10/1998 | Brisco | 280/607 |
| 5,826,910 | | 10/1998 | Ricks et al. | 280/618 |
| 5,876,045 | | 3/1999 | Acuna | 280/14.2 |
| 5,890,729 | | 4/1999 | Bayer et al. | 280/618 |
| 5,897,128 | | 4/1999 | McKinzie et al. | 280/607 |
| 5,913,530 | | 6/1999 | Berger et al. | 280/607 |
| 5,941,552 | | 8/1999 | Beran | 280/607 |
| 5,947,488 | * | 9/1999 | Gorza et al. | 280/607 |
| 5,947,508 | * | 9/1999 | Graf et al. | 280/613 |
| 6,022,041 | * | 2/2000 | Dailey et al. | 280/14.2 |
| 6,102,430 | * | 8/2000 | Reynolds | 280/618 |
| 6,155,578 | * | 12/2000 | Patterson | 280/607 |
| 6,203,051 | * | 3/2001 | Sabol | 280/618 |
| 6,206,402 | * | 3/2001 | Tanaka | 280/607 |

* cited by examiner

*Primary Examiner*—J. J. Swann
*Assistant Examiner*—Christopher Bottorff
(74) *Attorney, Agent, or Firm*—Jack C. Munro

(57) ABSTRACT

An angularly adjustable snowboard binding mount and method of adjusting such which utilizes a position altering plate which is fixedly mounted onto a snowboard. A baseplate is mounted on the position altering plate and is pivotally movable from a locked position to an unlocked position with the unlocked position being substantially ninety degrees from the locked position. The locked position locates the longitudinal axis of the boot binding substantially at ninety degrees relative to the longitudinal center axis of the snowboard. The unlocked position locates the longitudinal axis of the boot binding substantially in alignment with the longitudinal center axis of the snowboard. In the second embodiment of this invention, the boot binding is mounted on an adjustment plate which is mounted in conjunction with the baseplate. The position of the adjustment plate can be adjusted relative to the baseplate so as to accommodate to different initial mounting positions of the boot binding relative to the snowboard according to the desires of different riders.

16 Claims, 8 Drawing Sheets

ANGULARLY ADJUSTABLE SNOWBOARD BINDING MOUNT

BACKGROUND OF THE INVENTION

1) Field of the Invention

This invention relates generally to boot binding mounts for snowboards and more particularly to a boot binding mount which allows for the mounting position of the boot binding to be adjusted prior to riding of the snowboard and during riding of the snowboard permits the boot binding to be moved to a different position on the snowboard when the rider is not riding the snowboard but yet moving on snow.

2) Description of the Prior Art

Snowboarding is a recreational sport that uses a single elongated board to move on the snow rather than the two skis of the sport of skiing when the rider is travelling down an inclined snow covered terrain. The snowboard rider stands on the snowboard so that the rider's feet are positioned substantially perpendicular to the longitudinal center axis of the snowboard which happens also to be the direction of travel. This is a desirable position because the snowboarder is then permitted to maneuver the snowboard by rolling his or her feet back between the heels and balls of his or her feet which changes the impression within the snow and causes the snowboard to turn. The feet of the snowboarder are each mounted within a binding with this binding in turn being mounted on a binding mount that is mounted on the snowboard.

Snowboarders often desire to modify the transverse position of the bindings relative to the snowboard. More advanced snowboarders generally prefer an angle of approximately ninety degrees relative to the longitudinal center axis of the snowboard where beginning snowboarders prefer a forwardly facing angle of about ten to fifteen degrees which results in the binding being positioned seventy-five to eighty degrees relative to the longitudinal center axis of the snowboard. In the past, this adjustment has been accomplished by unbolting and repositioning of the entire binding. Normally, there are several bolts that are used to mount the binding to the snowboard. Each of these bolts have to be disengaged and the binding readjusted and then the bolts reengaged. This is a cumbersome and time consuming procedure.

At the present time, the vast majority of snowboard usage is by means of renting the snowboards. During the rental procedure, the rental operator is almost always required to adjust the particular angular position of the bindings according to the skilled rider. Therefore, the rental operator has no choice but to deal with the cumbersome and time consuming procedure of adjusting the bindings. Also, when the snowboarder is using of the snowboard out on the mountain, at times the snowboarder may want to change the angular position of his or her feet to accommodate to different snow conditions or to accommodate to different snowboarding styles, such as slalom racing, downhill cruising, freestyle acrobatics or jumping. If the snowboard rider wants to change the initially established position of the bindings relative to the snowboard, the snowboard rider has to carry with him or her appropriate tools such as possibly a screwdriver and a wrench in order to remove the mount, adjust its position, and then reinstall the mount. It would be desirable to utilize some form of a quick and easy adjustment that would eliminate this time consuming and cumbersome procedure.

Also, when the snowboarder is not riding of the snowboard but still wishes to maneuver himself or herself over terrain to negotiate lift lines and to get in and out of lift chairs, the fact that the snowboarder is mounted crosswise on the snowboard makes such movements difficult. Normally, the snowboarder disengages the rear foot leaving the forward foot still mounted within the snowboard. As a result, there is an unnatural walking type of movement that results that causes the snowboarder's leg to assume an unnatural position causing stress and strain on the entire leg including the vulnerable ankle and knee joint due to the snowboard being mounted at a transverse angle to the rider's foot. However, snowboarder's of the past have found this procedure to be inconvenient and time consuming. Therefore, it would be desirable to design a mechanism that could disengage and permit the binding of the forward foot on the snowboard to be pivoted so that the longitudinal axis of the binding is in substantial alignment with the longitudinal axis of the board rather than transverse to the board during the time that the snowboarder is maneuvering to and from ski lifts and other times when the snowboard is not being ridden.

Additionally, the prior art type of snowboard boot binding system locates the snowboard in a transverse position when the snowboarder is riding on a chairlift. On a typical chairlift, two, three or four riders sit side-by-side facing the direction travel of the chairlift. Since the front foot is still mounted on the binding, the snowboard extends at a transverse angle to this direction of travel thus interfering with other users of the chairlift as well as inducing an undesirable torque on the rider's leg caused by the weight of the snowboard. The user of a chairlift may be on the chairlift for as many as ten to fifteen minutes. This transverse location of the snowboard results in a rather uncomfortable position for this period of time as well as creating a possible injury due to the unnatural position of the snowboard rider.

SUMMARY OF THE INVENTION

An angularly adjustable snowboard binding mount which has a first embodiment that includes a position altering plate which is fixedly mounted to the snowboard. Mounted in conjunction with the position altering plate is a baseplate. A boot binding is to be fixedly mounted onto the baseplate. A spring biased locking mechanism is to be engageable with a notch formed in the position altering plate to lock the baseplate to the position altering plate. Movement of the locking mechanism to a disconnected position will permit the baseplate to pivot relative to the position altering plate which means that the boot binding, instead of being pointed in a transverse direction relative to the snowboard, is now pointing in a longitudinal direction relative to the snowboard. In the second embodiment of the invention, there is mounted an adjustment plate between the baseplate and the position altering plate. A locking pawl is connectable between the baseplate and the adjustment plate. The adjustment plate, which carries the boot binding, is to be adjustable relative to the baseplate with this adjustment to occur when the position altering plate is fixed relative to the baseplate. This second adjustment is to vary the mounted position of the boot binding on the snowboard to assume an angle between seventy-five degrees and ninety degrees.

The primary objective of the present invention is to construct an angularly adjustable snowboard binding mount which will permit a boot binding to be pivoted from a transverse position on the snowboard to a longitudinally aligned position on the snowboard which will permit the snowboard to be moved in alignment with the direction of travel during the time that the snowboard rider is moving to chairlifts.

Another objective of the present invention is to construct an angularly adjustable snowboard binding mount which will permit for a quick and easy adjustment of the initial mounting position of the boot binding on the snowboard which will eliminate the unbolting and repositioning procedure of a conventional mounting arrangement for a boot binding on a snowboard.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF THE PREFERRED EMBODIMENTS

Figure 1:
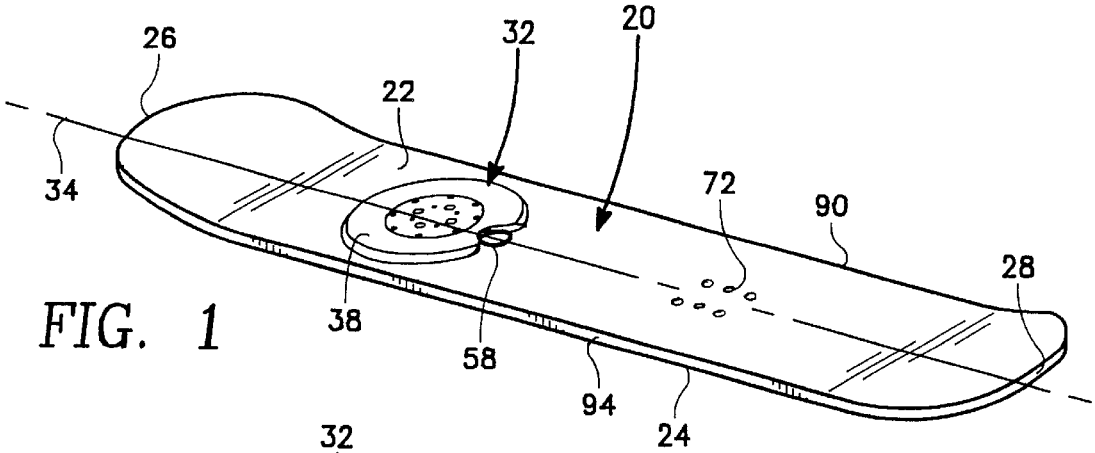
FIG. 1 is an isometric view of a typical snowboard showing the first embodiment of this invention being mounted to engage with the forward boot binding when mounted on the snowboard.
Figure 2:
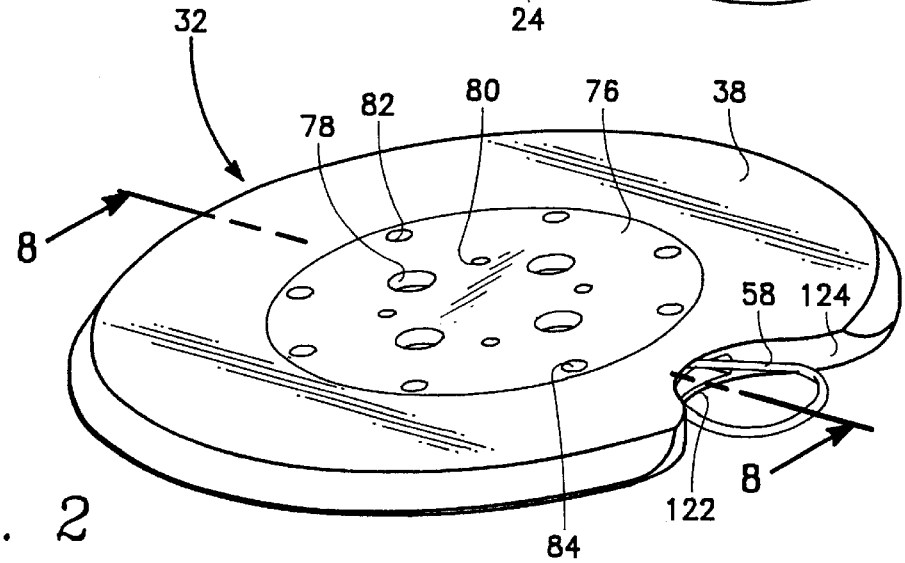
FIG. 2 is an isometric view of the first embodiment of angularly adjustable snowboard binding mount of the present invention.
Figure 3:
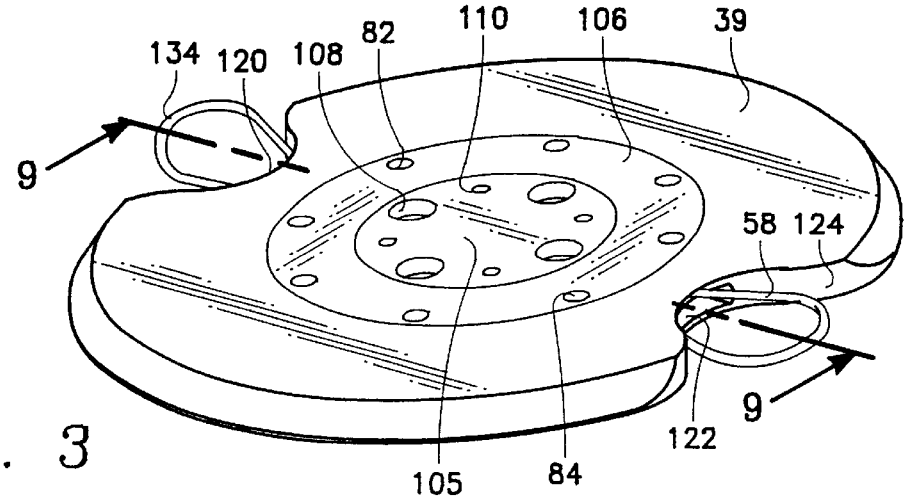
FIG. 3 is an isometric view of a second embodiment of angularly adjustable snowboard binding mount of the present invention.
Figure 4:
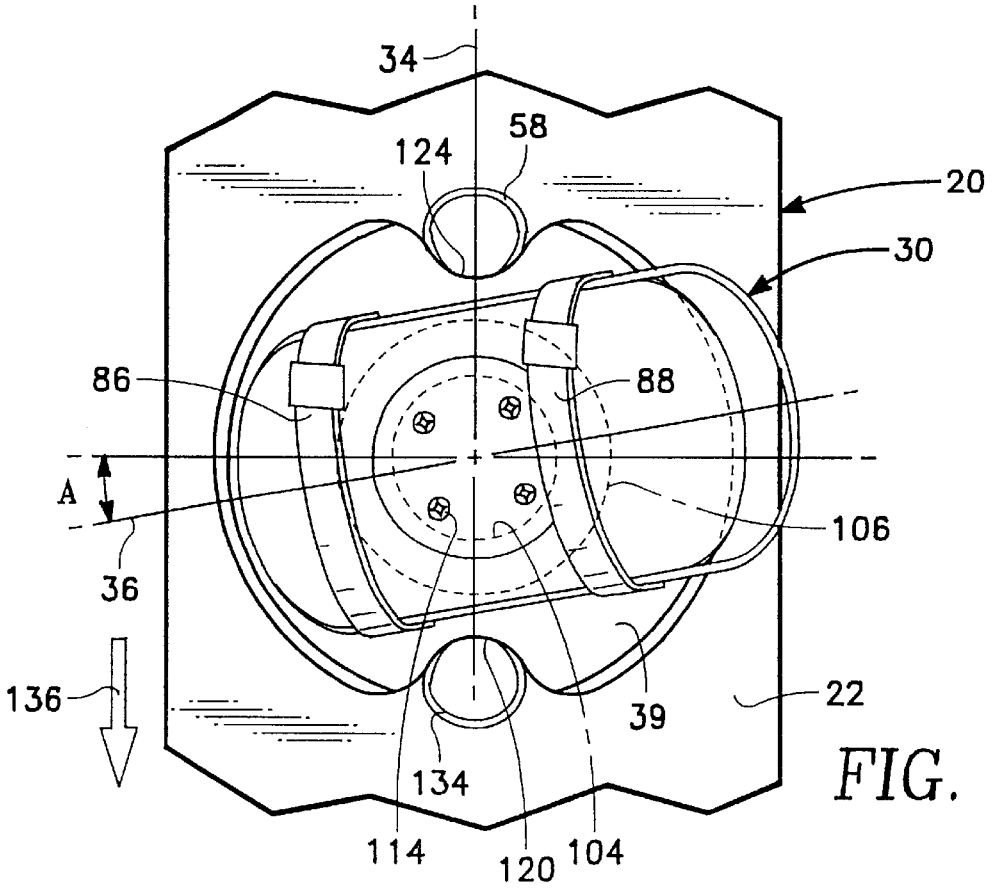
FIG. 4 is a top plan view showing a boot binding mounted in conjunction with the second embodiment of angularly adjustable snowboard binding mount of the present invention where the boot binding is located in a transverse position relative to the longitudinal center axis of the snowboard.
Figure 5:
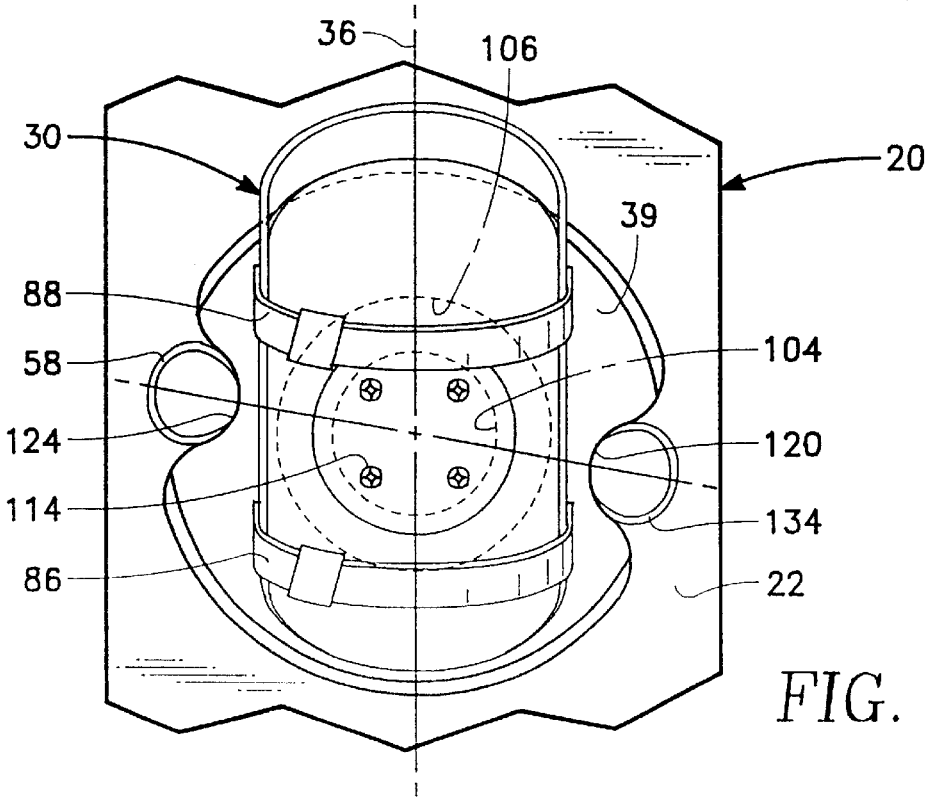
FIG. 5 is a view similar to FIG. 4 but showing the boot binding being moved to a longitudinally oriented position relative to the longitudinal center axis of the snowboard.
Figure 6:
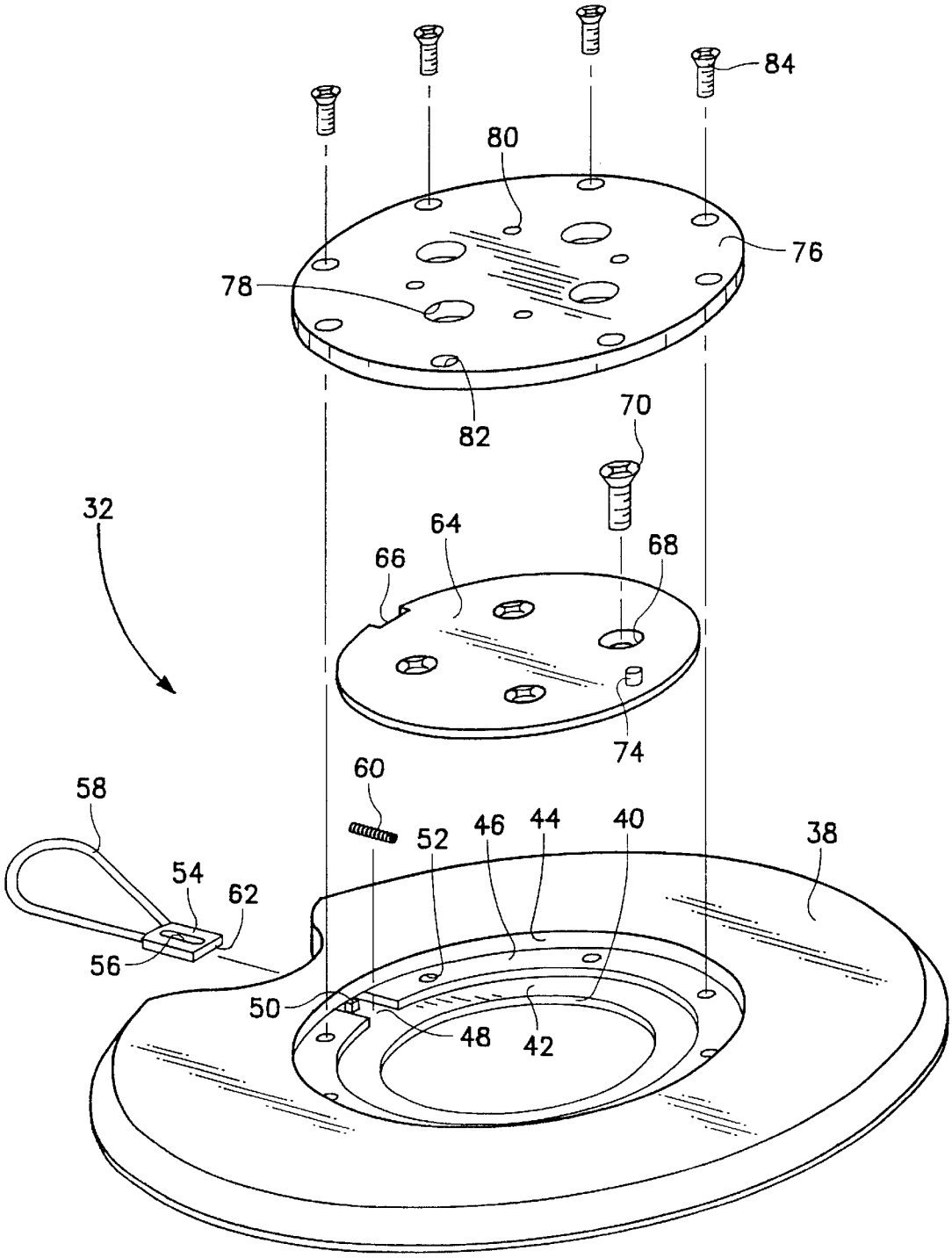
FIG. 6 is an exploded isometric view showing the different parts utilized in conjunction with the first embodiment of this invention.
Figure 7:
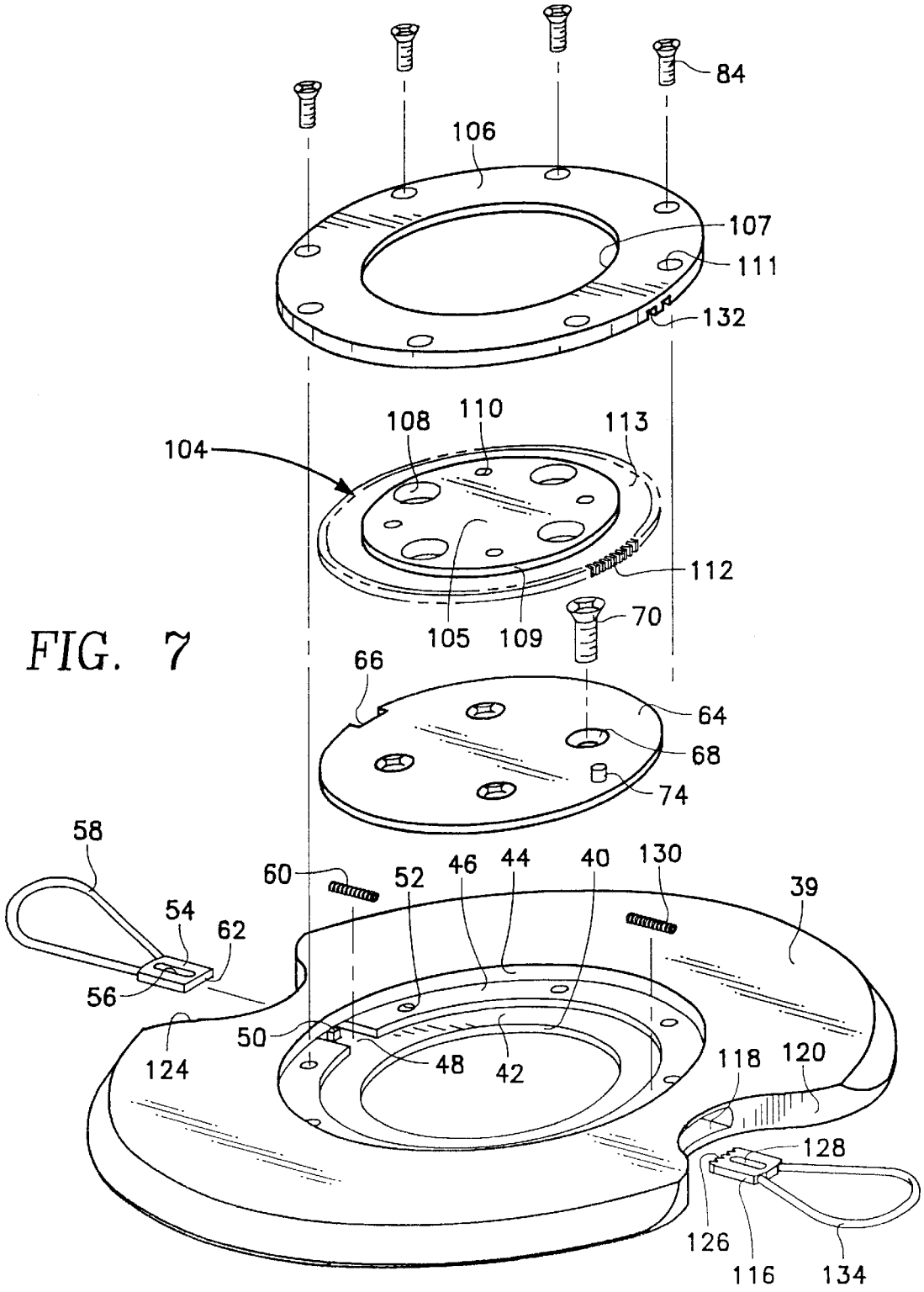
FIG. 7 is an exploded isometric view showing the different parts within the second embodiment of this invention.
Figure 8:
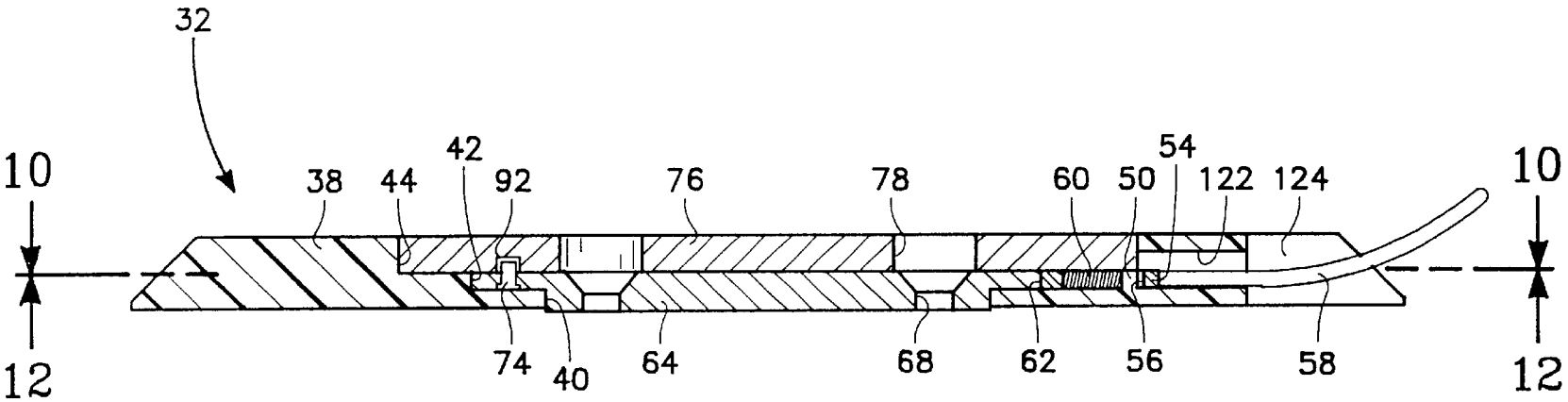
FIG. 8 is a cross-sectional view through the first embodiment of this invention taken along line 8—8 of FIG. 2.
Figure 9:
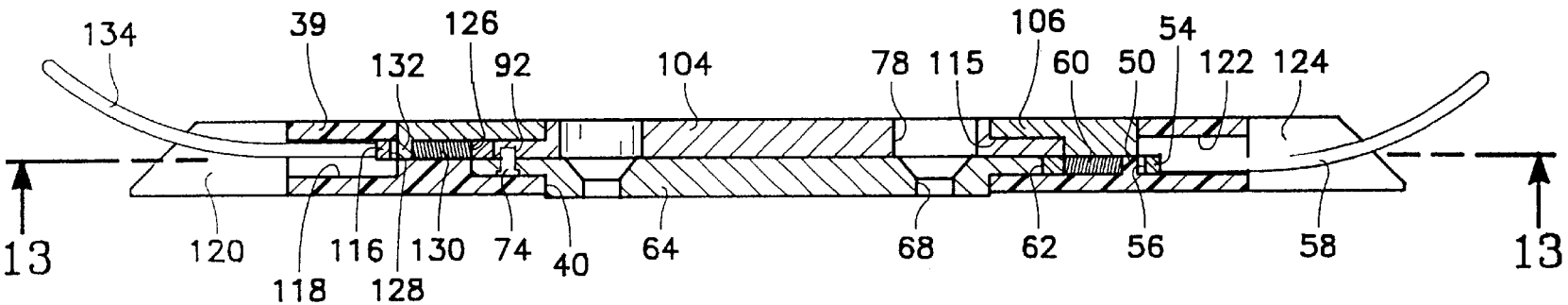
FIG. 9 is a cross-sectional view through the second embodiment of this invention taken along line 9—9 of FIG. 3.

Referring particularly to the drawings, there is shown in FIG. 1 a conventional snowboard 20 which has an upper surface 22 and a bottom surface 24. The snowboard 20 has a front edge 26 and a rear edge 28. A boot binding 30, shown in FIGS. 4 and 5, is to be utilized for securing of the front foot, that is the foot that is closest to the front edge 26, onto the snowboard 20. The securing mechanism for the boot binding 30 is the first embodiment 32 of this invention. Snowboard 20 has a longitudinal center axis 34. The boot binding 30 has a longitudinal axis 36.

The first embodiment 32 includes a circular shaped baseplate 38. Baseplate 38 includes a center hole 40. Surrounding the center hole 40 is a first annular chamber 42. Surrounding the annular chamber 42 is a second annular chamber 44. It is to be noted that the second annular chamber 44 is raised slightly from the first annual chamber 42 which is also raised slightly from the center hole 40. Mounted within the first annular chamber 42 is a ring 46 with the upper surface of this ring 46 defining the bottom wall of the second annular chamber 44. The ring 46 includes a cutout 48. Mounted on the baseplate 38 is a pin 50. The pin 50 is located within the cutout 48.

Formed within the ring 46 are a plurality of evenly spaced apart threaded holes 52. There are eight in number of the threaded holes 52. A locking member 54 is mounted within the cutout 48. The locking member 54 has an elongated slot 56. Attached to the locking member 54 is a pull ring 58. The pin 50 is to be located within the slot 56. Also located within the slot 56 is a coil spring 60. One end of the coil spring 60 abuts against the pin 50 and the opposite end of the coil spring 60 abuts against the outer end of the slot 56. The locking member 54 has an outer end 62. The locking member 54 is mounted within a hole 122 formed within the baseplate 38 with the pull ring 58 being located within notched out area 124 of the baseplate 38.

A position altering plate 64, which is circular shaped, is mounted within the first annular chamber 42. The position altering plate 64 has a notch 66 formed in its peripheral edge. The position altering plate 64 also has four evenly spaced apart holes 68 within which is to be mounted screw fasteners 70 with it being understood that there is a separate fastener 70 for each hole 68. The fasteners 70 are used to fixedly mount the position altering plate 64 onto the upper surface 22 of the snowboard 20. It is to be understood that the snowboard 20 also includes a series of holes 72 which are to be used to mount a boot binding, which is not shown, for the rear foot of the rider. The first embodiment 32 is intended to be used only with the front foot and is not intended to be used with the rear foot since when the rider is not riding the snowboard 20 but is traversing terrain between chairlifts, the rider's rear foot is normally disengaged from the binding on the snowboard 20. Therefore, the mount of embodiment 32 is not needed. The position altering plate 64 also has a pin 74 mounted thereon.

A disc shaped coupling plate 76 is to be matingly located within second annular chamber 44. The coupling plate 76 has four in number of holes 78, four in number of threaded holes 80 and eight in number of holes 82. The holes 82 are located directly adjacent the peripheral edge of the coupling plate 76. Each of the holes 82 are to connect with a fastener 84 with each fastener 84 to be secured to a hole 52. This means that the coupling plate 76 is fixedly secured to the baseplate 38. The holes 78 are merely for the purpose of providing access to each fastener 70 with each hole 78 to be alignable with a fastener 70 which will be for the purpose of mounting the first embodiment 32 of this invention to the upper surface 22 of the snowboard 20. The head of a conventional screwdriver is to be conducted through a hole 78 and is to connect with the head of fastener 70. The holes 80 are used for mounting of the boot binding 30 onto the coupling plate 76. Appropriate fasteners (not shown) are to be used.

The operation of the first embodiment 32 of this invention is as follows: When the snowboard rider (not shown) wishes to use the snowboard 20 to travel downhill, the rider will place his or her left foot within the binding 30. The straps 86 and 88 of the binding 30 are utilized to fixedly secure the binding 30 to the snowboard boot (not shown). Most individuals locate themselves on the snowboard 20 so that the rider faces the right edge 90 of the snowboard 20. Formed within the undersurface of the coupling plate 76 is an arcuate groove 92. The pin 74 is located within the arcuate groove 92. With the locking member 54 engaged with the notch 66 (locking position), the snowboard rider will be facing the right edge 90 of the snowboard and pin 74 is located at end 97 of groove 92. Now let it be assumed that the rider wishes to move his or herself along the terrain toward a chairlift. When doing so, it would be desirable to have the longitudinal center axis 34 of the snowboard 20 to align with the direction of travel (unlocking position). In order to achieve this, the rider is to manually grasp pull ring 58 and pull such outwardly compressing of spring 60 until the locking member 54 disengages from the notch 66. This will then permit the boot binding 30 and the baseplate 38 to be manually pivoted, with direction of arrow 99, relative to the position altering plate 64 with the direction of pivoting only being permitted by the arcuate groove 92 in the counterclockwise direction. The pivoting is to occur until the longitudinal center axis of the snowboard 28 is in alignment with the direction of travel and in alignment with the longitudinal axis 36 of the boot binding 30 which is the unlocking position. The pin 74 is now located at the opposite end 95 of the arcuate groove 92. Walking movement of the rider and dragging the snowboard 20 is then permitted. This position of the snowboard is maintained while on the chairlift until the rider is about ready to exit the chairlift. When the rider is ready to exit the chairlift to proceed downhill on the snowboard 20, the rider will swivel the boot binding 30 in a clockwise direction until the locking member 54 reengages with the notch 66 which is the locking position. It is to be noted that the locking member 54 does not engage with a notch when in the unlocking position. This is important so the rider does not need to disengage the locking member 54 prior to movement to the locking position. If a rider was trying to unlock the locking member 54 and then pivot such prior to exiting of the chairlift, such would be difficult and potentially injury prone to the rider and others. The rider then exits the chairlift and merely places his or her foot against the snowboard 20 and is now able to maneuver the snowboard 20 in the normal manner to get away from the chairlift so as to not be struck by the moving chair or be struck by subsequent riders. Normal usage of the snowboard 20 is then to occur with the rider first securing his or her trailing foot to the snowboard 20.

Figure 10:
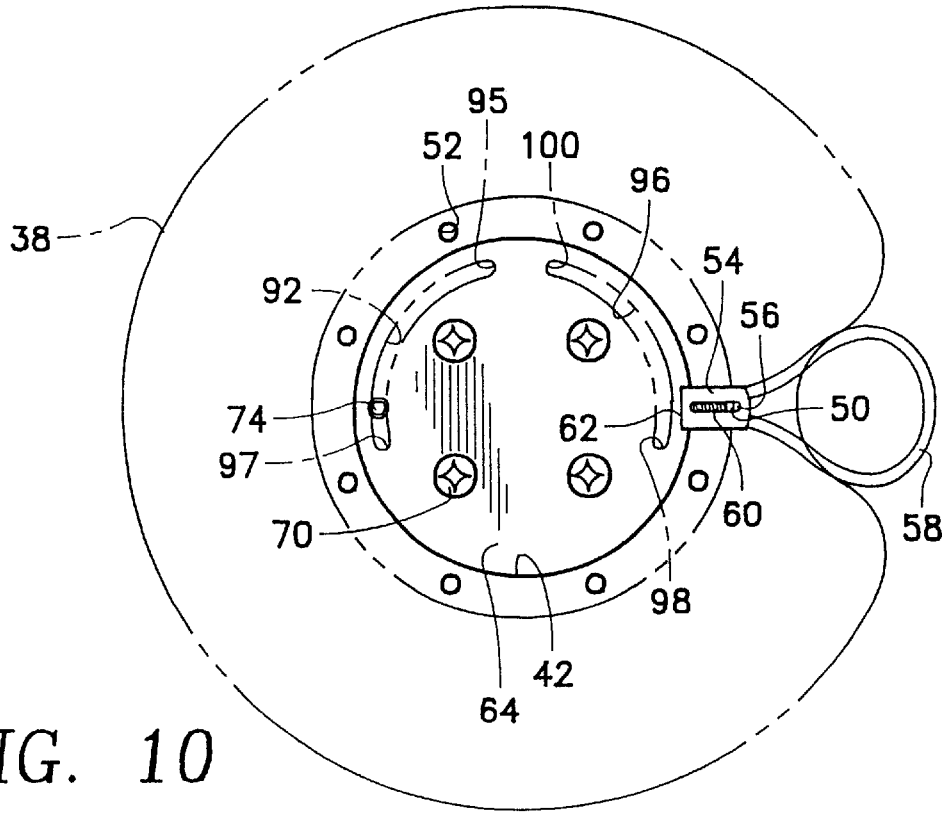
FIG. 10 is a cross-sectional view taken along line 10—10 of FIG. 8 showing the locking mechanism in the locked position.
Figure 11:
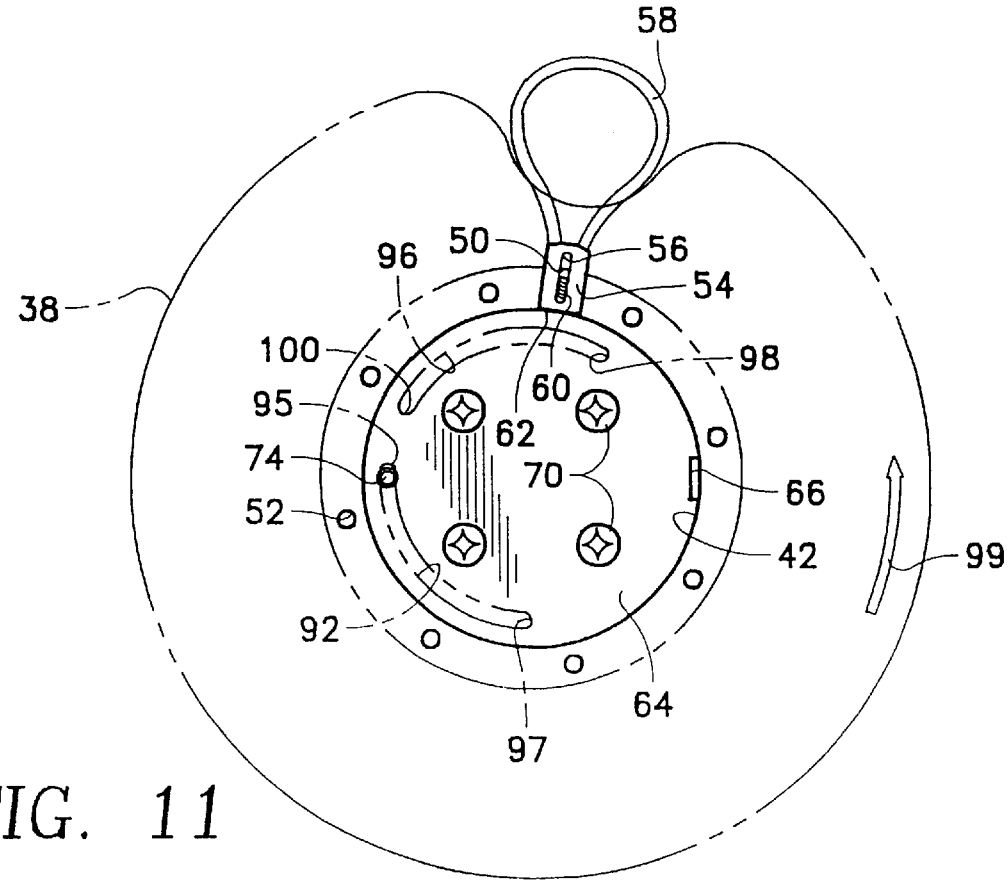
FIG. 11 is a view similar to FIG. 10 but showing the locking mechanism in the unlocked position and the snowboard binding mount moved to be substantially in a longitudinally oriented position.
Figure 12:
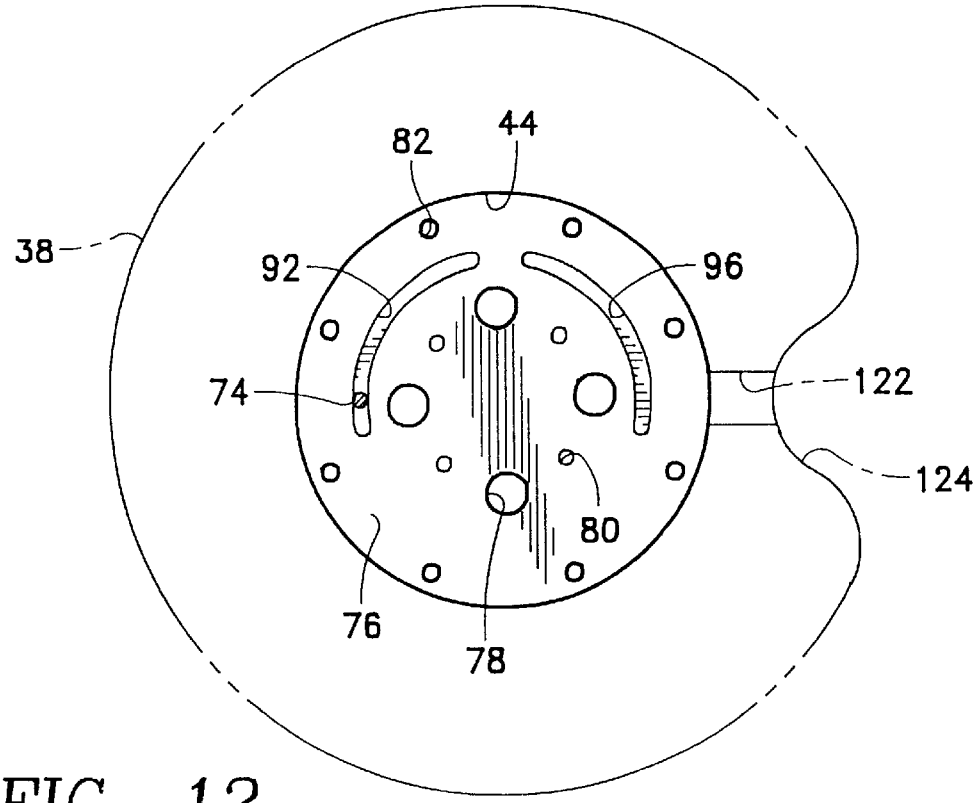
FIG. 12 is a cross-sectional view taken along line 12—12 of FIG. 8.
Figure 13:
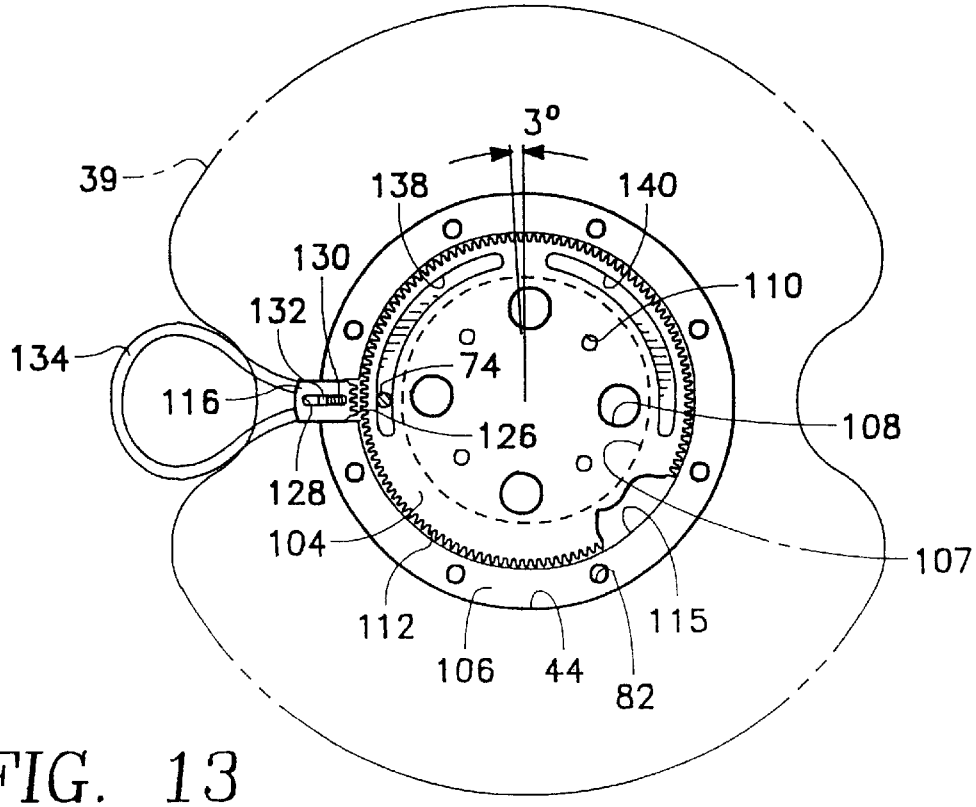
FIG. 13 is a cross-sectional view taken along line 13—13 of FIG. 9.
Figure 14:
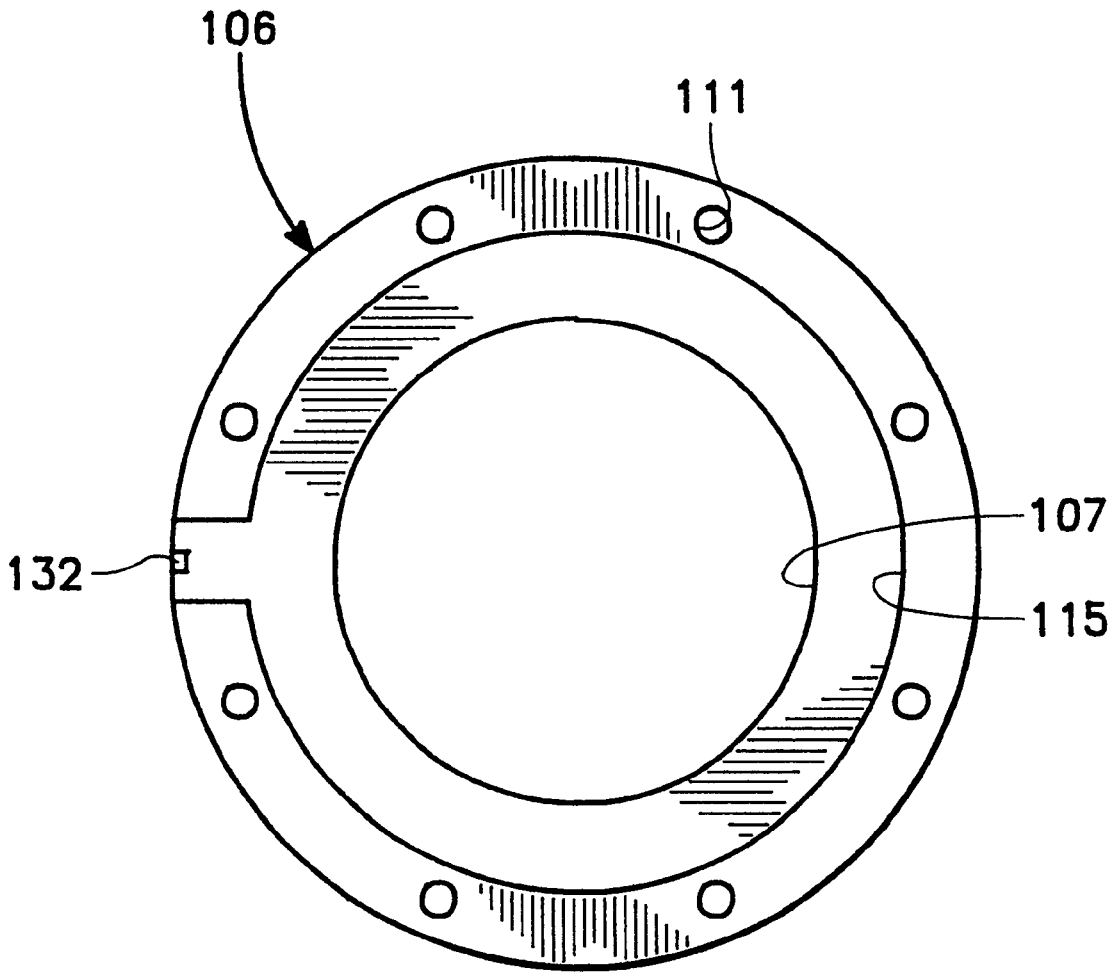
FIG. 14 is a view of the undersurface of the mounting ring that is used in the second embodiment of this invention.

Sometimes, a rider may desire to be located on the snowboard 20 facing the left edge 94. This is frequently referred to as a "goofy" mounting. In such an instance, there is provided within the undersurface of the coupling plate 76 a second arcuate groove 96. It is to be noted that, in referring particularly to FIG. 10, that there is shown both arcuate grooves 92 and 96. Actually, within FIG. 10, the arcuate grooves 92 and 96 would not be shown as FIG. 10 shows the upper surface of the position altering plate 64 and does not even show the coupling plate 76. However, for explanation purposes, the position of the arcuate grooves 92 and 96 have been included. When utilizing of the "goofy" mounting, the coupling plate 76 is to be disengaged from the baseplate 38 and turned one-hundred and eighty degrees. This will then locate the pin 74 directly adjacent end 98 of the groove 96 and the fasteners 84 are then resecured to the baseplate 38. This engaging of the locking member 54 from the notch 66 will then permit the baseplate 38 to pivot clockwise, and when the pin 74 is located at end 100 of the arcuate groove 96, the longitudinal axis 36 of the binding 30 will be in substantial alignment with the longitudinal center axis 34 of the snowboard 20. It is to be noted that the "goofy" mounting arrangement locates the rider's right foot as the forward foot and the regular mounting arrangement locates the left foot as the forward foot.

Referring particular to the second embodiment 102 of this invention, which is shown in FIGS. 3, 4, 5, 7, 9 and 13, similar numbers have been used to refer to similar parts. The primary difference in structure has to do with instead of using the coupling plate 76, there is utilized an adjustment plate 104 and a mounting ring 106. The adjustment plate 104 includes four in number of holes 108 which are for the same purpose as holes 78. The adjustment plate 104 also includes four in number of holes 110 which are to be used for securing of the boot binding 30 to the adjustment plate 104. Holes 108 and holes 110 are located within the center plateau 105 of plate 104. The adjustment plate 104 has a gear tooth peripheral edge 112 which is formed within an annular ledge 113 which is at a lower level from plateau 105 producing annular wall 109. The adjustment plate 104 and the mounting ring 106 are to be located within the second annular chamber 44 in a close fitting manner with the mounting ring 106 covering of the peripheral portion of the adjustment plate 104 in the area of the gear tooth peripheral edge 112. Fasteners 114 are to be used to securely mount the boot binding 30 to the holes 110. Ring 106 includes a series (eight in number) of holes 111 which are each to receive a fastener 84. The fasteners 84 then threadably secure with threaded holes 52. Mounting ring 106 has an enlarged center hole 107. Plateau 105 closely fits within center hole 107 with annular wall 109 abutting against the surface of hole 107. Annular ledge 113 closely fits within annular chamber 115 of ring 106.

The gear tooth peripheral edge 112 is to be engageable with a locking pawl 116. Locking pawl 116 is mounted within a hole 118 formed within the baseplate 39 with this hole 118 being located within notched out area 120 of the baseplate 39. The locking pawl 116 has a toothed forward edge 126 which is to be engageable with the gear toothed peripheral edge 112. The locking pawl 116 includes an elongated slot 128 within which is located a coil spring 130. The coil spring 130 abuts against the forward end of the slot 128 that is located closest to the toothed forward edge 126 and then abuts against a pin 132 which is integrally mounted onto the mounting ring 106. As a result, the locking pawl 116 is continuously biased toward engagement with the adjustment plate 104. A pull ring 134 is fixedly attached to the locking pawl 116 and is to be used to manually disengage the locking pawl 116 from the gear toothed peripheral edge 112. This disengagement will permit the boot binding 30 to be manually pivoted relative to the position altering plate 64 and the snowboard 20. Generally, more advanced snowboard riders want to have the longitudinal axis 36 located just about perpendicular to the longitudinal center axis 34 of the snowboard 20. However, less advanced riders generally prefer to have the boot binding 30 canted in a forwardly direction, such as depicted in FIG. 4 of the drawings. The arrow 136 is pointed toward the front edge 26 of the snowboard 20. This canting of the binding will normally be no more than fifteen degrees, which is shown as angle A in FIG. 4. Once the desired position of the boot binding 30 for the particular rider has been established, the pull ring 134 is released which will cause the coil spring 130 to move the locking pawl 116 so that the tooth forward edge 126 will reengage with the gear toothed peripheral edge 112. This now locks in position the adjustment plate 104 relative to the baseplate 38.

Formed within the bottom surface of the adjustment plate 104 are arcuate grooves 138 and 140. The grooves 138 and 140 function in the same manner and for the same reason as the grooves 92 and 96 respectively. The grooves 138 and 140 are for the purpose for pivoting of the baseplate 38 almost ninety degrees so that the longitudinal axis 36 of the boot binding 30 is to align with the longitudinal center axis 34 of the snowboard 20.

Each time the locking pawl 116 is disengaged from the gear toothed peripheral edge 112 and the adjustment plate 104 is pivoted an amount equal to the distance between the teeth of the gear toothed peripheral edge 112, the total amount of pivoting will be three degrees. This means that the total number of teeth in the gear toothed peripheral edge 112 is one hundred twenty teeth. However, it is to be considered to be within the scope of this invention that this number of teeth could be increased or decreased. However, the three degree of movement is a desirable number because this will give the snowboard rider the right to change the position from ninety degrees to eighty-seven degrees, to eighty-four degrees, to eighty-one degrees, to seventy-eight degrees and then to seventy-five degrees. It is not very likely that any snowboard rider would want to go lower than about seventy-five degrees. Although the gear toothed periphery edge 112 is shown to be entirely around the periphery of the adjustment plate 104, it is really only necessary to have gear teeth within thirty degrees of the three hundred and sixty degree periphery of the adjustment plate 104. The thirty degrees could be divided between a fifteen degree segment for the regular position of the rider facing the right edge 90 of the snowboard and another fifteen degree segment for when the rider faces the left edge 94 of the snowboard 20, which is known as the "goofy" position.

What is claimed is:

1. An angularly adjustable snowboard binding mount formed as a self contained unit which is adapted to be mounted on a snowboard comprising:

a position altering plate included within said self contained unit adapted to be fixedly mounted onto a snowboard, said snowboard having a longitudinal axis;

a baseplate included within said self contained unit and mounted in conjunction with said position altering plate, said baseplate adapted to have mounted thereon a boot binding apparatus, said baseplate being movable relative to said position altering plate between a first position and a second position, said first position fixes said baseplate to said position altering plate and is adapted to locate the boot binding apparatus so the longitudinal dimension of the boot binding apparatus is located transverse to said longitudinal axis of the snowboard, said second position is adapted to permit locating of the longitudinal dimension of the boot binding apparatus in substantial alignment with said longitudinal axis of the snowboard;

a coupling plate included within said self contained unit, said coupling plate being releasably secured to said baseplate and located against said position altering plate;

a pin and groove assembly connecting between said coupling plate and said position altering plate, said pin and groove assembly defining the limits of movement between said first position and said second position; and a locking member mounted conjunction with said baseplate and said position altering plate, with said locking member in a locking position said baseplate is fixed to said position altering plate, said locking member being manually movable to an unlocked position which disconnects said baseplate from said position altering plate to permit movement from said first position to said second position.

2. The angularly adjustable snowboard binding mount as defined in claim 1 wherein:

said position altering plate being centrally mounted relative to said baseplate.

3. The angularly adjustable snowboard binding mount as defined in claim 1 wherein:

said baseplate being pivotally movable relative to said position altering plate.

4. The angularly adjustable snowboard binding mount as defined in claim 1 wherein:

said locking mechanism being manually movable by means of a pull ring.

5. The angularly adjustable snowboard binding mount as defined in claim 1 wherein:

said locking mechanism being continuously spring biased toward said locking position.

6. The angularly adjustable snowboard binding mount as defined in claim 1 including:

means for adjusting the location of said first position, whereby said first position can be varied and preset according to the individual desires of each rider.

7. The angularly adjustable snowboard binding mount as defined in claim 6 wherein:

said means including an adjustment plate located directly adjacent said position altering plate, said adjustment plate being pivotally movable relative to said position altering plate to be located and fixable in any one of various angular positions.

8. The angularly adjustable snowboard binding mount as defined in claim 7 wherein:

said means includes a locking pawl which connects with a gear, said gear being mounted on said adjustment plate.

9. In combination of a snowboard, said snowboard comprising an elongated substantially planar member having a longitudinal center axis, an angularly adjustable snowboard binding mount for said snowboard, the improvement comprising:

a position altering plate fixedly mounted on said snowboard;

a baseplate mounted in conjunction with said position altering plate, said baseplate adapted to have mounted thereon a boot binding apparatus, said baseplate being movable relative to said position altering plate between a first position and a second position, said first position fixes said baseplate to said position altering plate and is adapted to locate the boot binding apparatus so the longitudinal dimension of the boot binding apparatus is located transverse to said longitudinal center axis, said second position is adapted to permit locating of the longitudinal dimension of the boot binding apparatus in substantial alignment with said longitudinal center axis;

a coupling plate, said coupling plate being releasably secured to said baseplate and located against said position altering plate; and a pin and groove assembly connecting between said coupling plate and said position altering plate, said pin and groove assembly defining the limits of movement between said first position and said second position; and a locking mechanism mounted in conjunction with said baseplate and said position altering plate, with said locking mechanism in a locking position said baseplate is fixed to said position altering plate, said locking mechanism being manually movable to an unlocking position which disconnects said baseplate from said position altering plate to permit movement from said first position to said second position.

10. The combination as defined in claim 9 wherein:

said position altering plate being centrally mounted relative to said baseplate.

11. The combination as defined in claim 9 wherein:

said baseplate being pivotally movable relative to said position altering plate.

12. The combination as defined in claim 9 wherein:

said locking mechanism being manually movable by means of a pull ring.

13. The combination as defined in claim 9 wherein:

said locking mechanism being continuously spring biased toward said locking position.

14. The combination as defined in claim 9 wherein:

means for adjusting the location of said first position, whereby said first position can be varied and preset according to the individual desires of each rider.

15. The combination as defined in claim 14 wherein:

said means including an adjustment plate located directly adjacent said position altering plate, said adjustment plate being pivotally movable relative to said position altering plate to be located and fixable in any one of various angular positions.

16. The combination as defined in claim 15 wherein:

said means includes a locking pawl which connects with a gear, said gear being mounted on said adjustment plate.

* * * * *